United States Patent [19]

Murray

[11] 4,077,541

[45] Mar. 7, 1978

[54] PARTICULATE MATERIAL FEEDING METHOD AND APPARATUS

[75] Inventor: Robert G. Murray, Palo Alto, Calif.

[73] Assignee: Stanford Research Institute, Menlo Park, Calif.

[21] Appl. No.: 692,842

[22] Filed: Jun. 4, 1976

[51] Int. Cl.[2] ..... B67B 7/00; G01F 11/20

[52] U.S. Cl. ..... 222/1; 222/410

[58] Field of Search ..... 222/410, 1; 214/17 CB

[56] References Cited

U.S. PATENT DOCUMENTS

| | | | |
|---|---|---|---|
| 2,822,097 | 2/1958 | Lee | 214/17 CB |
| 3,182,825 | 5/1965 | Zellerhoff | 222/410 X |

*Primary Examiner*—Allen N. Knowles

*Attorney, Agent, or Firm*—Victor R. Beckman

[57] ABSTRACT

Method and apparatus are shown for feeding particulate material into a pressurized container. A rotor is located within the pressurized container, and the rotor hub is connected to a combination drive and material supply tube which extends through a wall of the container in fluid-tight engagement therewith. Particulate material from an unpressurized supply source outside the container is fed to the rotor through the supply tube, and is discharged through radially extending flow passages formed in the rotor. Means are provided for restricting the flow of particulate material at the discharge end of the flow passages such that material flowing therein is compacted by centrifugal acceleration to substantially prevent flow of fluid from the pressurized container through the supply pipe while continuously supplying particulate material to the container.

27 Claims, 5 Drawing Figures

PARTICULATE MATERIAL FEEDING METHOD AND APPARATUS

BACKGROUND OF THE INVENTION

Many industrial processes involve the use of furnaces, reactor vessels, and the like, which operate at elevated pressures and to which particulate material involved in the process is fed. With some arrangements the particulate material is injected with a carrier gas under pressure. Also, slurry feeding methods are known in which a liquid-solid mixture is pumped into the high pressure vessel. With either arrangement the fluid (either gas or liquid) required to transport the particulate material may not be required in the process or, if required, the desired ratio of particulate material to fluid may be difficult to provide. Also, lock hoppers, or the like, are employed where relatively large quantities of particulate material are to be supplied. Batch, and not continuous, feeding of the particulate material is provided by such arrangements.

SUMMARY OF THE INVENTION AND OBJECTS

An object of the present invention is the provision of method and apparatus for feeding particulate material to a pressurized container which avoid many of the problems and shortcomings of prior art feeders used for such purpose.

An object of the present invention is the provision of method and apparatus for the continuous feeding of particulate material to a pressurized vessel without the need for a carrier fluid and substantially without escape of gas from the vessel through the particulate feed means.

The above and other objects and advantages are achieved by use of a rotor within the pressurized container to which particulate material is supplied from a source outside the container. The rotatably driven rotor is formed or provided with a plurality of generally radially extending flow passages through which the particulate material passes, and egress from the rotor is limited such that packing of the material within the rotor takes place by centrifugal acceleration thereof. Flow of the particulate material, and packing thereof within the rotor, may be controlled by controlling the rate of rotation of the rotor and/or control of the restriction provided at the discharge end of the rotor flow passages. Under certain operating conditions, a balance may be provided between the rate of flow of gas from the container due to the pressure difference across the particulate material and the gas flow rate into the container provided by the entrainment of gas in the void spaces of the particulate material which gas travels with the particulate material. Operation at either side of said balance point for net gas flow in either direction through the particulate material supply means also is contemplated. Preferably, the outer ends of the rotor passages from which the particulate material discharges are generally tapered, and the particulate material flows through a restricted passage formed between such tapered ends and the cooperating tapered inner wall of a surrounding annular valve member. The annular member and rotor are relatively axially movable for control of the restricted flow passage. Also, rotatable mounting means for the annular valve member is contemplated to allow for cut-off engagement of the valve member with the rotating rotor.

Figure 1:
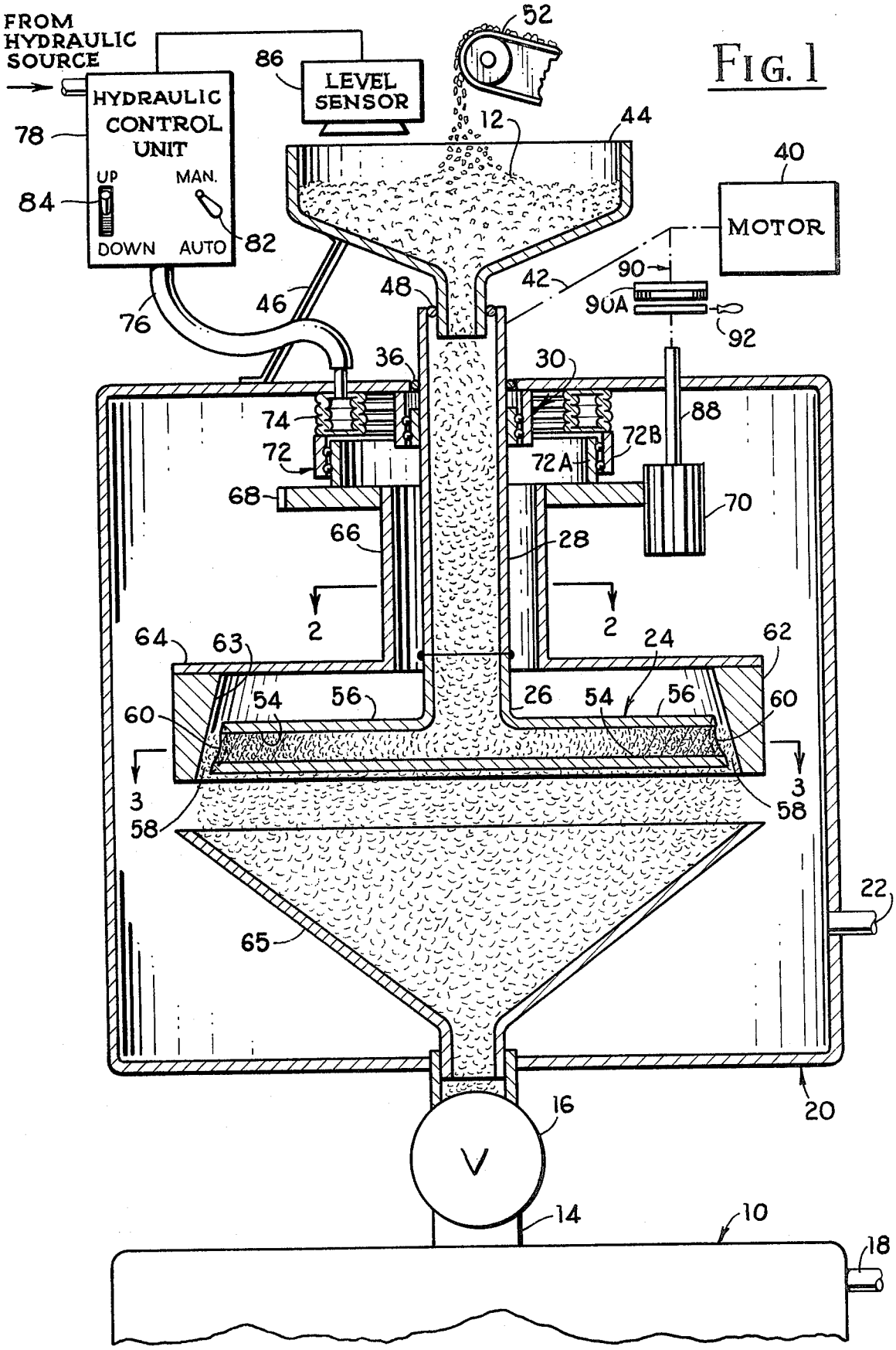
FIG. 1 is a vertical sectional view, with portions shown diagrammatically, of a feeder embodying this invention for feeding particulate material into a pressurized containment vessel.

Reference first is made to FIG. 1 wherein there is shown, for purposes of illustration, a fragmentary portion of a reactor vessel 10 within which some process, such as gasification, polymerization or the like, takes place at elevated pressure and often at elevated temperature. For example, the vessel may be included in a gasifier system for the conversion of coal 12, supplied thereto through a nozzle 14, and valve 16, to fuel in a gaseous state. Air and/or oxygen, and steam, commonly used in the coal gasification process e.g. the Lurgi process, may be supplied through an inlet pipe 18 to the reactor, and desired gases, including methane, may be withdrawn from the reactor vessel through suitable means, not shown. It is advantageous to use pressures of up to approximately 1000 psi in the reactor which, heretofore, has made the feeding of coal into the reactor difficult and expensive.

In the illustrated arrangement, the novel feeder of my invention is positioned within a pressurized containment vessel 20 connected through the nozzle 14 and normally open valve 16 to the reactor 10. As will become apparent, the feeder may be located within the reactor vessel without the need for such containment vessel 20, if desired. The containment vessel may be supplied with gas under pressure through an inlet 22 for pressurization thereof. In any case, the reactor 10 and containment vessel 20 pressures are substantially equal by reason of the interconnection thereof through the nozzle 14.

The particulate material feeder comprises a rotor 24 having a hub 26 attached to the lower end of a hollow shaft 28, which shaft serves as a combination drive shaft and material supply inlet tube for the rotor. The shaft 28 is shown extending through an aperture in the containment vessel, and a bearing 30 having one race attached to the vessel 20 and the other attached to the shaft 28 provides for the rotatable support thereof. A seal ring 36 is provided between the shaft and vessel to prevent leakage of gas thereat.

The shaft 28, and attached rotor 24, are driven by a motor 40 connected to the shaft by suitable drive connecting means 42 shown in broken line form in FIG. 1 for simplicity. Any suitable linkage including a pulley and belt arrangement may be used for connecting the motor and rotor. A hopper 44 is shown at the upper end of the supply shaft 28 to which coal 12, or other particulate material for use in the reactor 10, is fed. The hopper may be supported by brackets 46 (only one of which is shown) extending from the top of the vessel 20, and a seal ring 48 is shown between the hopper and shaft for preventing leakage of particulate material therebetween. Also, a conveyor 52 is shown for conveying coal to the hopper from a source not shown.

The rotor 24 is formed with two or more radially extending flow passages 54 circumferentially symmetrically located about the rotor hub 26. It here will be understood that the term 'radially extending' is intended to include flow passages with a radially extending component such that particulate material entering at the hub is caused to move along the passages under centrifugal force upon rotor rotation. For purposes of illustration, a rotor having a pair of diametrically opposite spouts 56 forming said flow passages is shown. A restricted flow passage 58 is formed adjacent the discharge end of the spouts to limit material flow therethrough. By impeding the egress of particulate material from the rotating spouts, the material is tightly packed within the flow passages 54 by centrifugal acceleration with rotor rotation.

Figure 2:
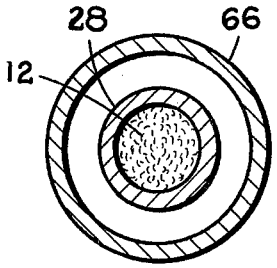
FIGS. 2 and 3 are sectional views, on a reduced scale, taken substantially along lines 2—2 and 3—3, respectively, of FIG. 1.
Figure 3:
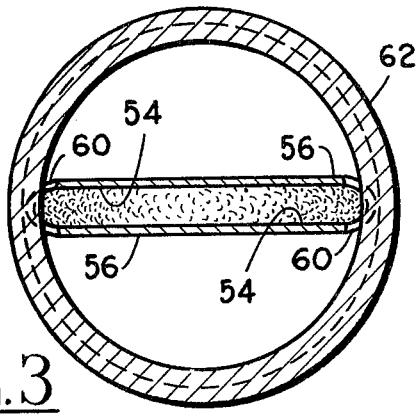

In the arrangement shown in FIGS. 1-3 the restricted flow passages 58 are formed between the spouts and an annular valve member 62 surrounding the rotor at a spaced distance therefrom. The spout discharge ends 60 are generally curved and tapered, (in the form of a segment of a conical surface) and a cooperating frustoconical inner wall surface 63 is formed on the annular member 62, between which discharge ends and frustoconical inner wall surface the restricted flow passages 58 are formed. Particulate material discharged from the rotor falls by gravity from the conical surface 63 into a hopper 65 from whence it flows into the reactor 10 through the nozzle 14 and valve 16. The valve 16 normally is open and is intended, primarily, for emergency use to cut off the supply of particulate material to the reactor in the case of abnormal operation.

In the illustrated arrangement the annular valve member 62 and rotor 24 are relatively axially movable for control of the restricted flow passages. Also, the annular valve member 62 may be rotatably mounted for rotation thereof with the rotor 24 when the valve member and rotor are axially movable into engaged condition wherein the flow of material from the rotor is shut off. As seen in FIG. 1, the annular valve member 62 is carried by an annular disk 64 formed with a central aperture through which the hollow shaft 28 extends. The disk 64 is attached to the lower end of a tube or casing 66, at the upper end of which is attached an annular spur gear 68, which, in turn, engages a pinion gear 70. The gears 68 and 70 are of sufficient thickness to allow for relative axial movement thereof during opening and closing operation of the annular valve member 62.

The gear 68 is rotatably attached through a bearing 72 to the lower end of an annular bellows 74 which bellows, in turn, is affixed at its upper end to the inner surface of the top wall of the containment vessel 20 by any suitable means, such as welding, not shown. The bearing 72 comprises races 72A and 72B fixed to or integrally formed with the gear 68 and bellows 74, respectively, for the support of the gear 68 by the bellows 74. Hydraulic fluid for the bellows is supplied thereto through a fluid line 76 and hydraulic control unit 78 from a hydraulic fluid pressure source, not shown. Application of increased fluid pressure to the bellows 74 serves to axially lower the annular valve member 62 toward valve closed condition, and decreased fluid pressure results in contraction of the bellows to raise the annular valve member.

The hydraulic control unit 78 is provided with a manually operated manual-automatic control valve 82 for switching between manual or automatic setting of the annular valve member 62. In the illustrated manual position, up-down control of the annular valve member 62 is under control of an up-down control valve 84 at the control unit. Hydraulic control units for such purposes are well known and require no detailed disclosure. With this arrangement, at start-up, the annular valve member 62 may be lowered into engagement with the rotor to block flow of particulate material therefrom. Particulate material is supplied to the rotor 24, and the rotor, with the engaged annular valve member 62, is rotated to pack the particulate material within the spouts before opening the valve 62, through operation of the control valve 84, thereby preventing blowout of the material through the rotor flow passages.

Generally, during feeding, the rotor and annular valve member should relatively rotate to avoid packing of the particulate material within the flow passages 58 to such an extent that particulate flow is completely blocked. In the illustrated arrangement the pinion gear 70 may be locked to prevent rotation of the annular valve member. As seen in FIG. 1 the pinion gear shaft 88 is connected through mechanical linkage 90, which includes a clutch 90A, to the motor 40. A brake 92 is provided at the driven clutch member for locking the pinion gear 70 against rotation when the clutch 90A is in the illustrated clutch disengaged condition. Not only may the annular valve member be locked against rotation but, with this arrangement the annular valve member 62 also may be brought up to the rotary speed of rotor by releasing the brake 92 and engaging the clutch 90A. When operating at the same rate of rotation as the rotor, the annular valve member 62 may be lowered into engagement with the rotor to cut off particulate material flow through the feeder. Of course, the valve 16 also may be closed to cut off the reactor 10 from the feeder at such times, and in emergency situations.

If desired, a level sensing unit 86 may be included in the system for sensing the level of particulate material in the hopper 44 and for adjusting the valve 62 position or motor 40 speed accordingly. In the illustrated arrangement the output from the level sensor 86 is supplied to the control unit 78 for automatic valve operation under control of the level sensor in the "automatic" position of the valve 82. With a sensed decreased level of material in the hopper 44 the valve actuator functions to move the valve member downwardly to further restrict the flow passages 58 through which the material passes and, conversely, with an increase in level, the valve is opened further to allow for a faster feed rate. The amount of opening of the valve member 62 is limited to assure that the material is sufficiently packed when flowing through the rotor to prevent blow-back.

The particulate material 12 flows through the feeder into the containment vessel under a pressure differential equal to the containment vessel pressure (in the illustrated arrangement). The force to feed against such pressure is provided, primarily, by centrifugal acceleration of the particulate material within the rotor 24 upon rotation thereof. Gravitational acceleration, of course, contributes to the total force but generally is small compared to the large centrifugal acceleration across the rotor, and often may be neglected. The centrifugal produced pressure tending to force the particulate material through the rotor depends upon the bulk density of the particulate material 12 within the spouts 56, the radial length of the spouts, and the rate of rotor rotation. For example only, a 4 foot diameter rotor, with 2 foot long spouts, and rotor rotation on the order of 2000 revolutions per second, would be sufficient to force pulverized coal against a 1000 psi pressure differential in a coal gasifier system. As noted above, the particulate material flow through the feeder must be regulated so that the feeder rotor remains full of solids at all times, and the above-described level sensing and valve control arrangement may be used for such purpose.

Figure 4:
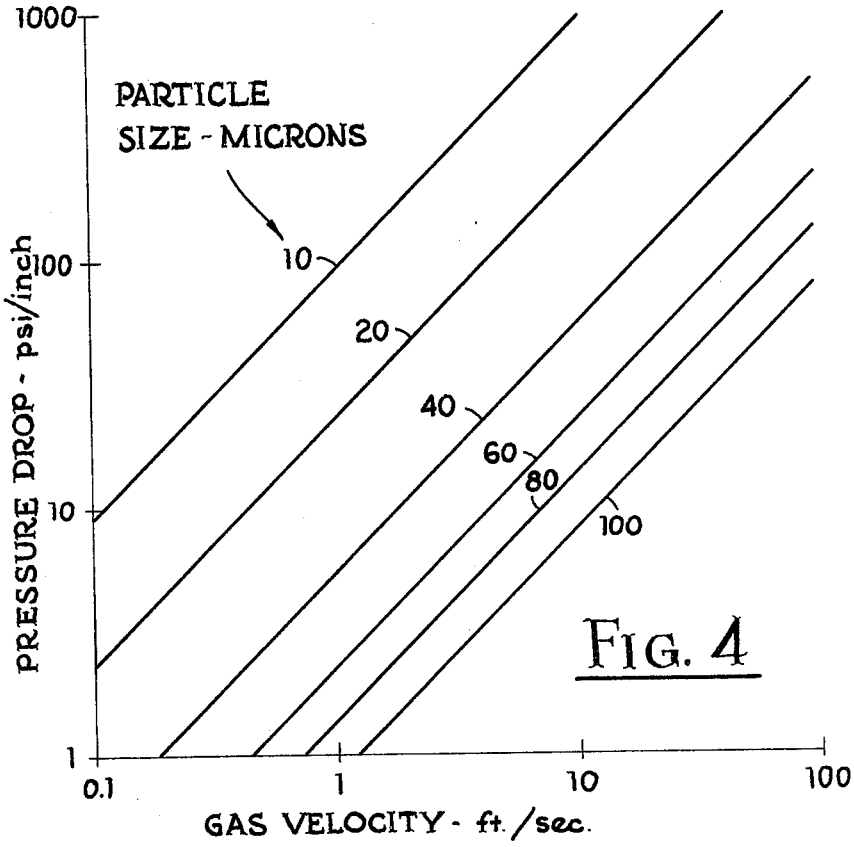
FIG. 4 is a plot showing pressure drop versus gas velocity for different average particle sizes.

The differential gas pressure across the particulate material within the feeder tends to cause gas flow therethrough. Dissipation of the pressure drop across the particulate material depends upon the particle size and shape, the void volume, gas viscosity and gas density. FIG. 4 presents the pressure drop per unit bed depth for a range of gas velocities and bed average particle sizes, and a gas viscosity of 0.02 centipose. It will be understood that FIG. 4 represents conditions within the supply tube 28 at, approximately, the location of lines 2—2, and not at the rotor. Gas pressure would be much higher adjacent the discharge end of the spouts 56, and a series of charts would be required to represent flow characteristics throughout the feeder. Entrained gas at the supply end of the feed system is carried within the void spaces of the particulate material in the feed system. If the flow rate of entrained gas flowing into the vessel equals the flow rate of gas back through the feed system from the vessel, the net gas flow is zero and no power would be expended in compressing gas injected with the particulate material. Of course, the feeder is not limited to such balanced operation, and operation with a net gas flow into, or from, the containment vessel also is contemplated. Regardless of the gas flow conditions through the feeder it is, of course, necessary to maintain adequate centrifugal acceleration of the material within the rotor to preclude blow out of the particulate material through the feeder system.

Figure 5:
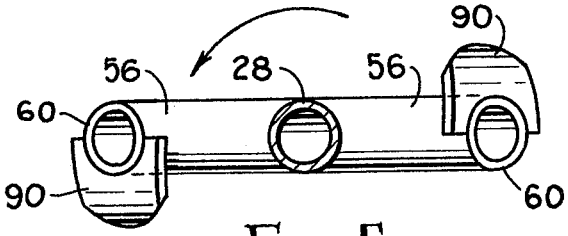
FIG. 5 is a plan view showing a portion of a modified form of rotor which includes scrapers at the outer free ends thereof.

The invention having been described in detail in accordance with the requirements of the Patent Statutes, various changes and modifications will suggest themselves to those skilled in this art. For example, as seen in FIG. 5, a plow shaped member 90 may be provided at the leading edge of the spouts 56 to scrape particulate material which may stick to the annular valve member 62 (not shown in FIG. 5) off therefrom. Such a device may be required for example where a sticky material (e.g. zinc stearate) is being fed which has a tendency to adhere to the annular valve 62. In this case the clutch 90A may be disengaged and the brake 92 applied for vertical movement only of the annular valve member 62 without rotational movement thereof to prevent drive rotation thereof with the rotor.

Other control means than the level sensor arrangement shown in FIG. 1 also may be used within the scope of the invention. For example, rotor speed control by control of the motor 40 speed is contemplated. Also, a gas or liquid carrier and/or reactant may be included with the particulate material if desired where the net flow thereof is into the reactor. Obviously, the invention is not limited to use with any particular particulate material. Comminuted, granulated, powdered, flaked, and like materials may be fed in accordance with the invention. It is intended that the above and other such changes and modifications shall fall within the spirit and scope of the invention as defined in the appended claims.

I claim:

1. A method for continuous feeding of particulate material to a container against a gas pressure differential, comprising, supplying particulate material from a supply source to a rotor within the container through which rotor the material flows, providing a controlled volume restricted flow passage at the outer periphery of the rotor to restrict the rate of flow of the particulate material from the rotor for compaction of said material within the rotor, and during operation controlling the restricted flow passage independently of the gas pressure differential and rate of rotation of said rotor for control of the rate of flow of particulate material from the rotor.

2. The method for continuous feeding of particulate material as defined in claim 1 which includes, gravity feeding the particulate material to the rotor through a supply tube extending through a container wall and to which said rotor is attached.

3. The method for continuous feeding of particulate material as defined in claim 2 which includes rotatably mounting said supply tube in the container wall, and rotatably driving said supply tube for rotation of said rotor attached thereto.

4. The method for continuous feeding of particulate material as defined in claim 2 including, rotating the supply tube about the tube axis for rotation of the attached rotor.

5. The method for continuous feeding of particulate material as defined in claim 1 wherein said particulate material flows through a plurality of generally radially extending spouts comprising said rotor within which spouts said material is compacted by centrifugal acceleration by rotation of the rotor.

6. Apparatus for continuous feeding of particulate material from a supply source to a container against a gas pressure differential comprising, a rotor formed with a hub inside the container, a supply tube connected to the hub of the rotor and extending through a container wall in fluid-tight engagement therewith, means for supplying particulate material through the supply tube to the rotor though which said material flows radially outwardly from the hub, means for rotating said rotor, means for restricting the flow of material from the rotor such that material flowing therein is compacted by centrifugal acceleration thereof to substantially prevent gas flow from the container through said rotor, and means independent of the gas pressure differential and rate of rotation of said rotor for controlling said flow restricting means for control of the rate of flow of material from the rotor during operation of the apparatus.

7. The apparatus for continuous feeding of a particulate material as defined in claim 6 wherein, said supply tube is rigidly connected to said rotor, and wherein said rotor is rotated through said supply tube by said means for rotating said rotor.

8. Apparatus for continuous feeding of particulate material from a supply source to a container against a gas pressure differential comprising, a rotor formed with a hub inside the container, a supply tube connected to the hub of the rotor and extending through a container wall in fluid-tight engagement therewith, means for supplying particulate material through the supply tube to the rotor though which said material flows radially outwardly from the hub, means for rotating said rotor, and means including an annular member surrounding the rotor at a spaced distance therefrom to form a restricted flow passage between said rotor and annular member for restricting the flow of material from the rotor such that material flowing therein is compacted by centrifugal acceleration thereof to substantially prevent gas flow from the container through said rotor.

9. The apparatus for continuous feeding of particulate material as defined in claim 8 including, means carried by said rotor for scraping particulate material from said annular member.

10. The apparatus for continous feeding of particulate material as defined in claim 8 wherein, said rotor is formed with a plurality of radially extending spouts at uniform circumferentially spaced locations about said hub, said restricted flow passages being formed between said annular member and outer free ends of said spouts.

11. The apparatus for continuous feeding of particulate material as defined in claim 8 wherein, said annular member is formed with a frusto-conical shaped inner wall surface and the rotor is formed with a cooperating outer end to form a restricted flow passage inclined to the rotor axis.

12. The apparatus for continuous feeding of particulate material as defined in claim 11 including, means for relatively axially moving said rotor and annular member for control of said restricted flow passage formed therebetween.

13. The apparatus for continuous feeding of particulate material as defined in claim 12 wherein, said rotor and annular member are relatively axially movable into engagement to cut off the restricted flow passage therebetween, and means for rotatably mounting said annular member for rotation with said rotor in said cut off condition.

14. The apparataus for continuous feeding of particulate material as defined in claim 6 wherein, said rotor is formed with a plurality of radially extending flow passages at uniformly circumferentially spaced locations about the hub through and in which said particulate material is passed and compacted, respectively.

15. The apparatus for continuous feeding of particulate material as defined in claim 6 wherein said means for control of the rate of flow of material from the rotor includes an axially movable annular member surrounding said rotor.

16. Apparatus for continuous feeding of particulate material from a supply source to a container against a gas pressure differential comprising, a rotor formed with a hub inside the container, a supply tube connected to the hub of the rotor and extending through a container wall in fluid-tight engagement therewith, means for supplying particulate material through the supply tube to the rotor through which said material flows radially outwardly from the hub, means for rotating said rotor, means for restricting the flow of material from the rotor such that material flowing therein is compacted by centrifugal acceleration thereof to substantially prevent gas flow from the container through said rotor, level sensing means having an output responsive to the level of particulate material at said material supplying means, and means for controlling flow rate of said material within the rotor in accordance with said output from the level sensing means.

17. The apparatus for continuous feeding of particulate material as defined in claim 6 wherein, said means for control of the rate of flow of material from the rotor includes means for closing said restricting means to block the flow of material from the rotor during rotor rotation independent of the rate of rotor rotation.

18. In apparatus for control of the continuous flow of particulate material from a supply source to a container against a gas pressure differential, which apparatus includes a rotatably driven rotor within the container to which the material is fed and by means of which the material is centrifugally accelerated for flow against the gas pressure differential and passage through a restricted flow passage at the rotor outlet, the improvement wherein, said restricted flow passage is formed by use of an annular member surrounding the rotor at a spaced distance from the rotor outlet for uniform compact flow of said particulate material through the rotor, and means for controlling the flow passage between said rotor and annular member for controlled volume flow of material from the rotor.

19. In apparatus of the type defined in claim 18 including, means carried by said rotor for scraping particulate material from said annular member.

20. In apparatus of the type defined in claim 18 wherein said rotor includes a hub and a plurality of radially extending spouts at uniformly spaced locations about said hub, said restricted flow passage being formed between said annular member and the outer free ends of said radially extending spouts.

21. In apparatus of the type defined in claim 18 wherein, said rotor is rotatably driven about the rotor axis of rotation, and said annular member is formed with a frusto-conical shaped inner wall and said rotor is formed with a cooperating outer end to form said restricted flow passage, which passage is inclined to the rotor axis.

22. In apparatus of the type defined in claim 21 wherein, said means for controlling the flow passage includes means for relatively axially moving said rotor and annular member to control the spacing therebetween.

23. In apparatus of the type defined in claim 22 wherein, said rotor and annular member are relatively axially movable into engagement to cut off the restricted flow passage.

24. In apparatus of the type defined in claim 23 including, means for rotatably mounting said annular member for rotation thereof with said rotor when said rotor and annular member are in cut off condition.

25. In apparatus as of the type defined in claim 18 which includes, material supply means for the supply of particulate material to said rotor, said controlling means including, level sensing means for sensing the level of particulate material within said supply means, and means responsive to the output from said level sensing means for controlling the flow passage for controlling the flow rate of particulate material within said rotor.

26. A method of transferring particulate material through a supply tube extending through an isolating wall from a zone of low pressure gas to a zone of higher gas pressure without concurrently allowing gas from the higher pressure zone to flow through the supply tube to the low pressure zone, which method includes along material flow passage means within the higher pressure zone, densely packing said particulate material by centrifugal acceleration for continuous travel of said material and entrained gas in one direction into the higher pressure zone along said flow passage means at a substantially constant velocity which is at least equal to the velocity of higher pressure gas travelling in the oppoiste direction thereat whereby there is no net flow of gas from the higher pressure zone to the low pressure zone through said supply tube.

27. In a method as defined in claim 26 wherein the pressure drop of gas flowing through the densely packed particulate material is substantially equal to the difference in pressure between the higher pressure zone and low pressure zone for substantially no net transfer of gas through the supply tube.

* * * * *

UNITED STATES PATENT AND TRADEMARK OFFICE

CERTIFICATE OF CORRECTION

PATENT NO. : 4,077,541

DATED : March 7, 1978

INVENTOR(S) : Robert G. Murray

It is certified that error appears in the above-identified patent and that said Letters Patent are hereby corrected as shown below:

Column 5, line 1, delete "second" and substitute --minute--.

Signed and Sealed this

*Ninth* Day of *January 1979*

[SEAL]

*Attest:*

RUTH C. MASON
*Attesting Officer*

DONALD W. BANNER
*Commissioner of Patents and Trademarks*